US010710852B2

(12) United States Patent
Ferrone

(10) Patent No.: US 10,710,852 B2
(45) Date of Patent: Jul. 14, 2020

(54) PORTABLE AUTO RACK

(71) Applicant: Rock A. Ferrone, Tarentum, PA (US)

(72) Inventor: Rock A. Ferrone, Tarentum, PA (US)

( * ) Notice: Subject to any disclaimer, the term of this patent is extended or adjusted under 35 U.S.C. 154(b) by 70 days.

(21) Appl. No.: 16/111,599

(22) Filed: Aug. 24, 2018

(65) Prior Publication Data

US 2019/0135597 A1 May 9, 2019

Related U.S. Application Data

(60) Provisional application No. 62/550,592, filed on Aug. 26, 2017.

(51) Int. Cl.

| | |
|---|---|
| ***B66F 5/04*** | (2006.01) |
| ***B66F 7/28*** | (2006.01) |
| ***B66F 7/04*** | (2006.01) |
| ***B66F 7/06*** | (2006.01) |
| ***B66F 7/26*** | (2006.01) |

(52) U.S. Cl.

CPC ..... *B66F 5/04* (2013.01); *B66F 7/04* (2013.01); *B66F 7/0625* (2013.01); *B66F 7/26* (2013.01); *B66F 7/28* (2013.01)

(58) Field of Classification Search

CPC .... B66F 3/00; B66F 3/10; B66F 3/245; B66F 7/007; B66F 9/04

See application file for complete search history.

(56) References Cited

U.S. PATENT DOCUMENTS 3,582,043 A 6/1971 Tranchero
3,844,535 A * 10/1974 Dorough, Jr. ..... B66F 3/16 254/103
5,484,134 A * 1/1996 Francis ..... B66F 7/04 254/2 B
6,116,577 A 9/2000 McCanse
6,279,685 B1 8/2001 Kogan et al.
6,315,079 B1 * 11/2001 Berends ..... B66F 3/46 187/203
6,505,815 B1 * 1/2003 Dellamore ..... B66F 7/04 254/2 B (Continued)

OTHER PUBLICATIONS

Bob Paradiso, LED Strip trail effect, https://www.youtube.com/watch?v=R9wbYRV1AEM , Oct. 1, 2013.

(Continued)

*Primary Examiner* — Lee D Wilson

(74) *Attorney, Agent, or Firm* — Blynn L. Shifeler; Krisanne Shideler; BLK Law Group

(57) ABSTRACT

A portable auto lift includes a plurality of vehicle engaging arms configured to selectively engage and support a vehicle, a frame coupled to and supporting the plurality of vehicle engaging arms a moveable carriage coupled to and supporting the frame and the plurality of vehicle engaging arms; a vertical support post configured to receive the movable carriage that supports frame and the vehicle engaging arms, the vertical support post further including a vertically adjustable portion for selectively vertically adjusting the height of the vertical support post; and a hydraulic system for selectively moving the moveable carriage along a length of the vertical post, including selectively moving the carriage along a length of the vertically adjustable portion. The vertically adjustable portion maybe pivoted, removable, or telescoping.

19 Claims, 4 Drawing Sheets

(56) References Cited

U.S. PATENT DOCUMENTS

| | | | | |
|---|---|---|---|---|
| 8,256,577 | B2 | 9/2012 | Kritzer | |
| 8,998,460 | B2 | 4/2015 | Dantas | |
| 9,611,128 | B2 * | 4/2017 | Van Houten | B66F 3/46 |
| 9,950,916 | B2 * | 4/2018 | Jaipaul | B66F 3/46 |
| 2010/0224841 | A1 * | 9/2010 | Liljedahl | A61G 7/1017 254/120 |
| 2012/0018688 | A1 | 1/2012 | Finkbeiner | |
| 2013/0233651 | A1 | 9/2013 | Kritzer | |
| 2014/0061559 | A1 * | 3/2014 | Spinazze | B66F 5/00 254/7 R |
| 2015/0232308 | A1 | 8/2015 | Uhl | |
| 2019/0135597 | A1 * | 5/2019 | Ferrone | B66F 5/04 |

OTHER PUBLICATIONS

Inspired LED, Automotive Lift Light | Inspired LED, https://www.youtube.com/watch?v=6wZ8spn4DhE , Jul. 21, 2015.

* cited by examiner

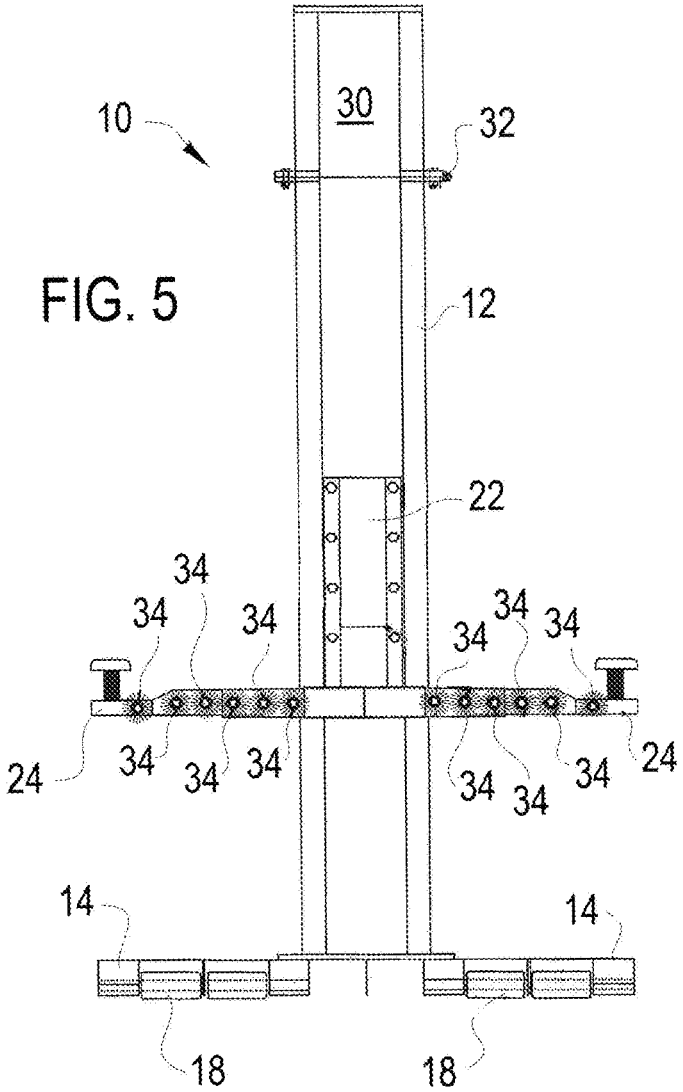
FIG. 5
FIG. 6
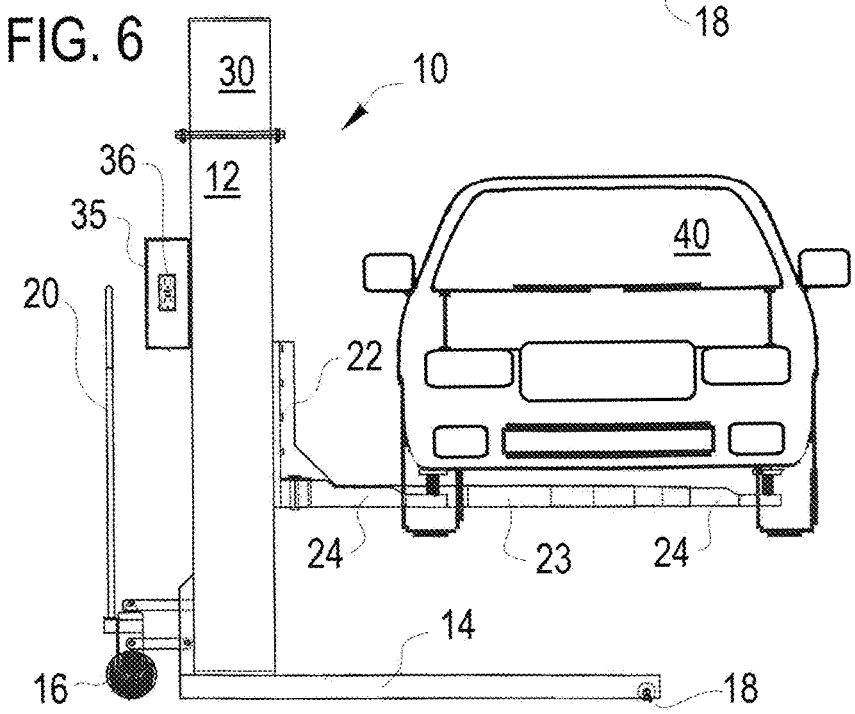

PORTABLE AUTO RACK

RELATED APPLICATIONS

The present application claims the benefit of Application Ser. No. 62/550,592 filed Aug. 26, 2017 entitled Portable Auto Rack, which application is incorporated herein by reference.

BACKGROUND OF THE INVENTION

1. Field of the Invention

The present invention relates to portable auto racks, also commonly called portable automobile lifts, and particularly to hydraulic automobile lifts having one or two posts and associated moveable carriage.

2. Background Information

A wide variety of post-type automobile lifts or racks have been previously known and used in the automobile repair business and by hobbyists to provide access to the underside of an automotive vehicle. The terms lift and rack are used interchangeably herein. Post lifts can be either of the in-ground or above-ground variety. In-ground post lifts usually have one or two vertically ascending columns mounted below the floor of a garage or service area, which columns are raised hydraulically to lift the vehicle. Above-ground post lifts generally have one, two or four vertical columns or "posts," each of that includes a carriage that rides up and down the post. The carriages each include a frame with outwardly extending outriggers or arms that engage the undercarriage of a vehicle to be lifted. Traditionally, these posts have been permanently installed in a fixed position.

Portable above-ground post lifts or auto racks are also known in the prior art. These prior art auto lifts include portable lifting columns having wheels for moving them from place to place. In order to stabilize the lifting columns while in use, the lifting columns generally include large bases having forwardly extending legs. These legs serve to keep the columns from tipping forwardly when a load is applied to the arms.

U.S. Pat. No. 8,256,577 and related Publication No 2013-0233651, which are incorporated herein by reference, teach a portable automobile lift which includes a plurality of portable lifting columns and a portable power unit.

U.S. Pat. Nos. 8,251,553 and 8,998,460, which are incorporated herein by reference, teach a vehicle lift system, comprising: a) a support structure supporting a vehicle; b) a movable support surface associated with fixed wheels of the vehicle, the movable support surface arranged generally flush with the support structure and located towards the first end of the support structure, the movable support surface configured to permit limited motion of the fixed wheels relative to the support structure; and c) at least one lighting module mounted to one of the support structure and the movable support surface, the lighting module configured to illuminate an underside region of the vehicle.

U.S. Pat. No. 6,315,079, which is incorporated herein by reference, teaches a portable automobile lift having separate lifting columns each with a carriage controllably driven in a manner to provide simultaneous actuation of the control of all lifting columns.

U.S. Pat. No. 6,279,685, which is incorporated herein by reference, teaches a twin post automobile lift that has a master and slave cylinder system in which the maser and slave cylinders each drive a lifting carriage, and each of the lifting carriages is mounted within, and is restricted to longitudinal travel within, an upright member. In the event that there is a loss of pressure in the hydraulic system under load, it is important that the lift be prevented from descending unexpectedly, or uncontrolledly. The upright can be manufactured in the form of a roll formed channel section. The legs of the channel section are formed to define guides for guide followers mounted on the lifting carriage, thereby restraining the travel of the lifting carriages to travel in the vertical direction. The lifting carriage has a rack formed on its back face. The rack is nested within the upright member and is not visible in use. The back of the channel is formed with an outwardly protruding step to accommodate the rack. A safety stop, in the nature of a spring loaded safety dog, is mounted to the upright and extends through the wall of the protrusion to engage the rack.

U.S. Pat. No. 6,279,685, which is incorporated herein by reference, teaches a wheel engaging vehicle lift for raising a vehicle relative to the ground and for supporting the vehicle in a raised position includes first and second support columns standing vertically upward from the ground. A first carriage is movably attached to the first support column and a second carriage is movably attached to the second support column. A first pair of arms extend away from the first carriage and a second pair of arms extend away from the second carriage, wherein the first and second pairs of arms are each rotatable about a substantially vertical axis proximate to a first end of the arms. The structure enables a conventional two-post frame engaging lift to be easily and readily converted into a two-post wheel engaging vehicle lift, and vice versa.

One problem encountered with conventional post type car lifts is that the height of the posts can prevent their use in certain applications, namely they cannot fit through a conventional residential garage door or be used in many residential garage locations. Sizing the posts to only residential applications will limit the full range of the lift. Low-profile lifts, generally scissor type arrangements, have been developed, but the construction of these limits the access provided to the vehicle. There remains a need for simple, universal portable post type automobile lift that does not limit access to the vehicle in use.

SUMMARY OF THE INVENTION

The present invention relates to a portable auto lift or rack including a plurality of vehicle engaging arms configured to selectively engage and support a vehicle; a frame coupled to and supporting the plurality of vehicle engaging arms; a moveable carriage coupled to and supporting the frame and the plurality of vehicle engaging arms; a vertical support post configured to receive the movable carriage that supports frame and the vehicle engaging arms, the vertical support post further including a vertically adjustable portion for selectively vertically adjusting the height of the vertical support post; and a hydraulic system for selectively moving the moveable carriage along a length of the vertical post, including selectively moving the carriage along a length of the vertically adjustable portion. The portable auto lift according to invention may provide wherein the vertically adjustable portion is one of pivoted, removable, or telescoping.

Another aspect of the present invention provides a portable auto lift including a vehicle engaging assembly configured to selectively engage and support a vehicle; a moveable carriage coupled to and supporting the vehicle engaging assembly; a vertical support post configured to receive the movable carriage that supports frame and the vehicle engaging arms, the vertical support post further including a vertically adjustable portion for selectively vertically adjusting the height of the vertical support post, wherein in a first position the vertically adjustable portion is aligned with a remainder of the vertical support post to extend an effective height of the vertical post and in a second position the vertically adjustable portion is non-aligned with the remainder of the vertical support post to decrease an effective height of the vertical post relative to the extended position; and a hydraulic system for selectively moving the moveable carriage along a length of the vertical post, including selectively moving the carriage along a length of the vertically adjustable portion.

Another aspect of the present invention provides a portable auto lift including a vehicle engaging assembly configured to selectively engage and support a vehicle; a moveable carriage coupled to and supporting the vehicle engaging assembly; a vertical support post configured to receive the movable carriage that supports frame and the vehicle engaging arms, the vertical support post further including a vertically adjustable portion pivoted to the vertical support post for selectively vertically adjusting the height of the vertical support post, wherein in a first position the vertically adjustable portion is aligned with a remainder of the vertical support post to extend an effective height of the vertical post and when pivoted to a second position the vertically adjustable portion is non-aligned with the remainder of the vertical support post to decrease an effective height of the vertical post relative to the extended position, and wherein the moveable carriage is moveable along a length of the vertical post, including selectively moving the carriage along a length of the vertically adjustable portion.

Another aspect of the invention is incorporating in array of LED lights into the support frame. The lights may include some adjustability and the ability to turn off individual LED lights as desired. Another aspect of the present invention is providing a power take off outlet on at least one of the support posts. Further aspect of the present invention is providing cantilevered leg rollers configured to be selectively moved to a disengaged position when the lift is in use. Another aspect of the invention is providing a slight angle relative to vertical to the vertical post and thus to the associated carriage travel relative to vertical to improve stability of the lift.

These and other advantages of the present invention will be clarified in the following description taken together with the following figures in which like elements represent like elements throughout.

BRIEF DESCRIPTION OF THE FIGURES

FIG. 5 is a schematic front view of a portable vehicle lift with a vertically adjustable post according to the present invention further including LED lighting elements on the arms thereof; and FIG. 6 is a schematic side view of a portable vehicle lift with a vertically adjustable post according to the present invention further including a power take of provided on the post;

BRIEF DESCRIPTION OF THE PRESENT EMBODIMENTS

Figure 8:
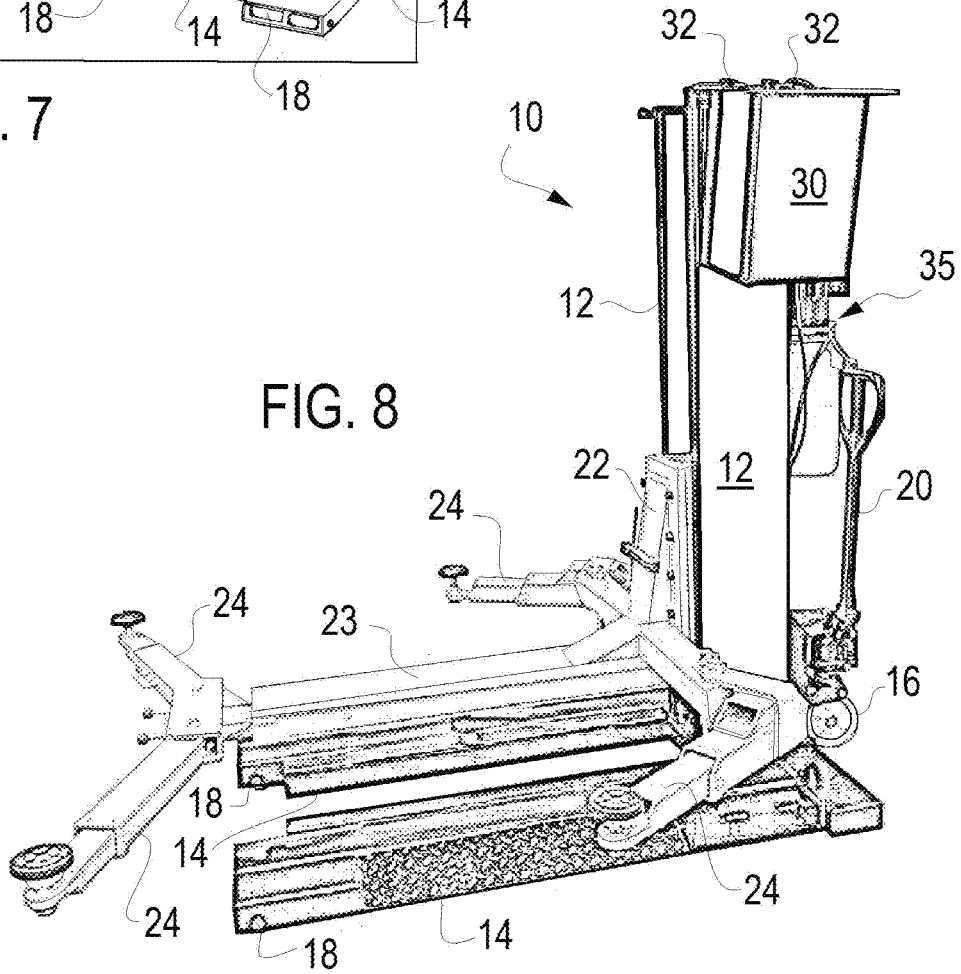

The present invention relates to a portable vehicle lift 10, also called a portable auto rack 10 best shown completely in FIG. 8, having a vertical support post 12 configured to receive a hydraulically movable carriage 22 that supports a frame 23 with vehicle engaging arms 24. As described below the portable auto lift or rack according to the invention provides a plurality of vehicle engaging arms 24 configured to selectively engage and support a vehicle 40; a frame 23 coupled to and supporting the plurality of vehicle engaging arms 24; a moveable carriage 22 coupled to and supporting the frame 23 and the plurality of vehicle engaging arms 24; a vertical support post 12 configured to receive the movable carriage 22 that supports frame 23 and the vehicle engaging arms 24, the vertical support post 12 further including a vertically adjustable portion or member 30 or 30' for selectively vertically adjusting the height of the vertical support post 12; and a hydraulic system 35 for selectively moving the moveable carriage 22 along a length of the vertical post 12, including selectively moving the carriage 22 along a length of the vertically adjustable portion 30 or 30' when it is aligned with the vertical post 12. The portable auto lift 10 according to invention may provide wherein the vertically adjustable portion 30 or 30' is one of pivoted, removable, or telescoping as discussed further below.

The present lift 10 is disclosed in connection with a single post 12 with a cantilevered frame 23 (AKA beam) supporting vehicle engaging arms 24. Collectively the frame 23 and vehicle engaging arms 24 form a vehicle engaging assembly. The center frame 23 and vehicle engaging arms 24 is a particularly common lift arrangement preferred by users due to the access given to the vehicle 40 when the lift is in use. The details of the frame 23 and arms 24 are not discussed in detail as they are well understood by those in the art.

The aspects of the present invention discussed below (except for the angled post 12 modification) can be equally implemented in a lift 10 with two posts 12 in which the vehicle engaging frame 23 extends from the carriage 22 on the first post 12 to a second carriage 22 riding upon a second opposed post 12. The one post version shown is preferred as it has advantages in portability and access advantages, however the dual post version has the advantage of avoiding the design requirements of the cantilevered structure (i.e. the high torque forces that must be accounted for). The construction of the two post version of the present invention need not be discussed in detail.

Figure 7:
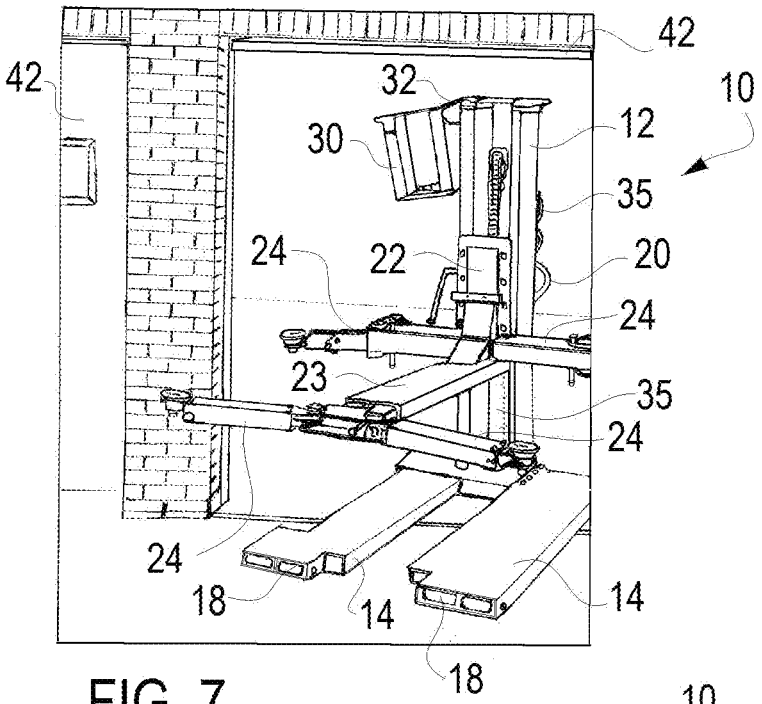
FIGS. 7-8 are perspective views of a portable vehicle lift with a vertically adjustable post according to the present invention.

The vertical post 12 is typically a hollow steel beam type structure in which the carriage 22 rides. The hydraulic system 35 moves the carriage 22. The hydraulic system 35 is generally conventional and includes a hydraulic cylinder that can also be housed in the post 12, controls therefor typically mounted on the post 12, ratchet load holding/safety elements within the inner post 12, limit switches on the post 12, hydraulic reservoir typically on the post 12, and a release mechanism (for releasing the load holding elements to allow for lowering of the lift 10) which is also associated with the post 12. These elements operate in a conventional fashion and the operation need not be described herein and most of these conventional elements are generally not shown in schematic FIGS. 1-6. The reservoir and control panel of the hydraulic system 35 are shown in FIG. 8, the control panel is schematically shown in FIG. 6 and the cylinder is shown in FIG. 7.

In the single post 12 version of lift 10 as shown, the lift 10 includes cantilevered steel legs 14 (sometimes called a base) extending out in front of the post 12. The legs 14 prevent the lift 10 from pitching forward in operation lifting a vehicle 40. In the two post 12 embodiment of the present invention, the legs 14 would not be cantilevered and would couple to the opposing post 12.

The lift 10 is portable and includes a selectively engaged rear wheel assembly 16 coupled to the post rearward of the post 12 and wheels or rollers 18 on the forward end of the legs 14. The rear wheel assembly 12 includes a handle 20 to selectively engage the wheels 16 with the ground for movement of the lift 10. This construction and operation of the wheel assembly 16, handle 20 and rollers 18 is conventional and known.

One aspect of the present invention is to have the cantilevered leg rollers 18 configured to be selectively moved to a disengaged position when the lift 10 is in use. Any adjustable configuration may be used that allows the rollers 18 to be moved into and out of engagement with the ground. Moving the rollers 18 out of engagement with the ground when the lift is positioned in the operational position will prevent loading of the rollers 18 and a flattening (over time) of the rollers 18 in use. A flattening of the rollers 18 will hinder the mobility of the portable lift, reducing the effectiveness of the lift 10. The legs 14 have enough room to accommodate the rollers 18 in the retracted position. Any number of mounting and moving mechanisms to accomplish this retractable rollers 18 can be implemented, although it may be more easily adopted and accepted by users if such a roller engagement mechanism is foot activated.

The carriage 22 is coupled to frame 23 that supports the arms 24 that are positioned beneath the car 40 at lift points to raise the car. The arms 24 extend from the horizontal frame or beam 23 extending from the carriage 22. The horizontal frame 23 can be considered either as part of the carriage 22 or more generally as a fixed part of the vehicle engaging assembly. The arms 24 are manually moveable relative to the frame 23 and carriage 22 to allow the arms 24 to be positioned in a desired lift point. The arms 24 are typically secured in a desired position with a locking or securing mechanism generally known in the art, such as a set pin.

The key feature of the lift 10 of the present invention is the inclusion of a post extension member 30 configured yield an adjustable operational height to the post 12 and lift 10. The post extension member 30 yields a vertically adjustable portion for selectively vertically adjusting the height of the vertical support post 12 as discussed below.

Figure 1A:
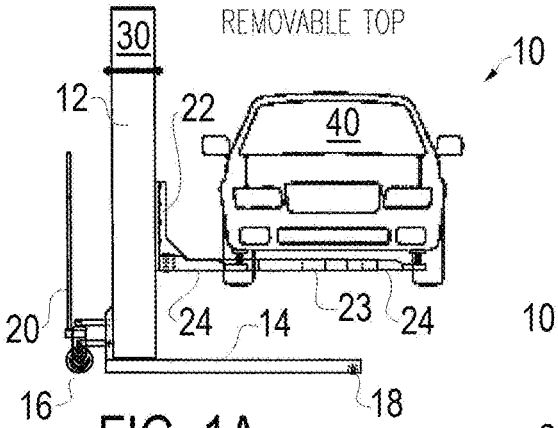
FIG. 1A is a schematic side view of a portable vehicle lift with a vertically adjustable post according to one embodiment of the present invention.
Figure 1B:
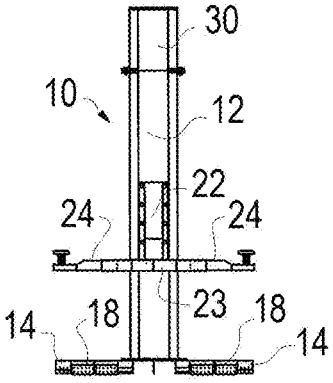
FIG. 1B is a schematic front end view a portable vehicle lift with a vertically adjustable post according to FIG. 1A.
Figure 1C:
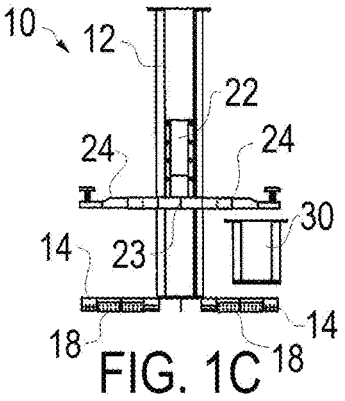
FIG. 1C is a schematic front end view a portable vehicle lift with a vertically adjustable post according to FIG. 1A with the post shown in a shortened position.

In the embodiment of FIGS. 1A-C the post extension member 30 is a section identical to the shape of the post 12 (or the remainder of the post 12 where member 30 is considered part of the post 12) and is coupled to the top end of the post 12, via bolts or other suitable, removable coupling. With the post extension member 30 in position on the post 12 the carriage 22 can ride up the entire combined height of the post 12 and the member 30. In a first position the vertically adjustable portion formed by member 30 is aligned with a remainder of the vertical support post 12 to extend an effective height of the vertical post 12. As discussed below in a second position the vertically adjustable portion formed by member 30 is non-aligned with the remainder of the vertical support post 12 to decrease an effective height of the vertical post 12 relative to the extended position.

When the lift 10 is to be used in a restricted height environment or moved through a restricted height, such as a residential garage door 42, the member 30 is removed from the post 12, such as unbolting. With the member 30 removed, the lift 10 can be used to move the carriage 22 up the height of the post 12 in a conventional fashion.

The hydraulic controls of the hydraulic system 35 of the lift 10 will include a mechanism to limit the operation of the cylinder to only the height of the post 12 when the member 30 is removed. This can be accomplished with a mechanical limit switch engaged by the carriage 22 at the relevant height, and which switch is toggled into and out of position with the removal or installation of the member 30. Other proximity sensor technology can be used to accomplish the dual operating positions technology.

The post extension member 30 gives two operational heights to the lift 10 such that it can be easily utilized in traditional locations at full height (with the member 30 attached) and in restricted height areas (with the member 30 removed) such as when it is moved through a residential garage or used in areas with low ceiling heights. The size of the member 30 should be selected to allow the lift 10 to operate as a conventional commercial lift when the member is attached to the post 12 and to allow the lift 10 to fit through residential garage door heights (about 7') when the member 30 is removed. The two alternative operational heights for the lift can greatly increase the application for the mobile lift 10. The post extension member 30 can be considered as a removable part of the post 12.

Figure 2A:
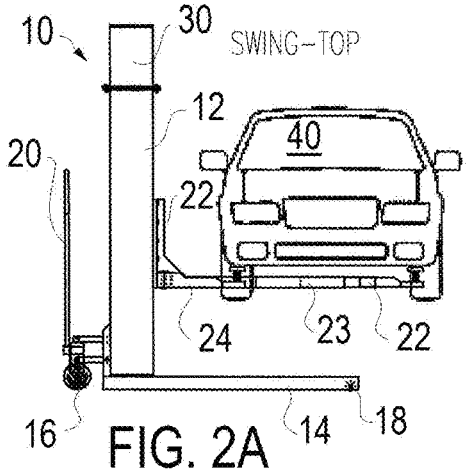
FIG. 2A is a schematic side view of a portable vehicle lift with a vertically adjustable post according to another embodiment of the present invention.
Figure 2B:
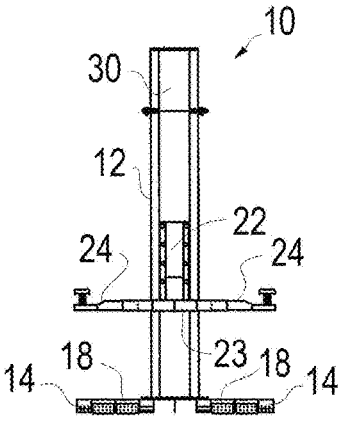
FIG. 2B is a schematic front end view a portable vehicle lift with a vertically adjustable post according to FIG. 2A.
Figure 2C:
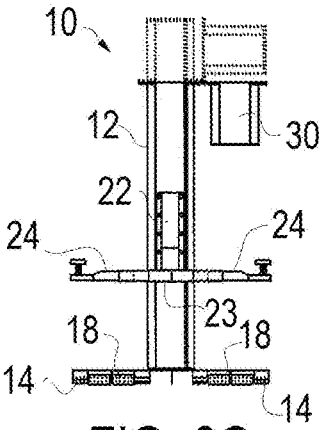
FIG. 2C is a schematic front end view a portable vehicle lift with a vertically adjustable post according to FIG. 2A with the post shown in a shortened position.
Figure 3A:
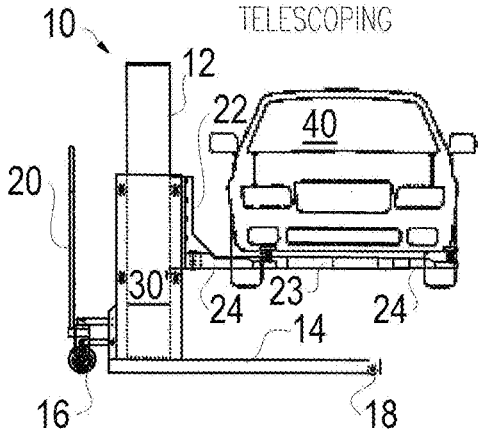
FIG. 3A is a schematic side view of a portable vehicle lift with a vertically adjustable post according to another embodiment of the present invention.
Figure 3B:
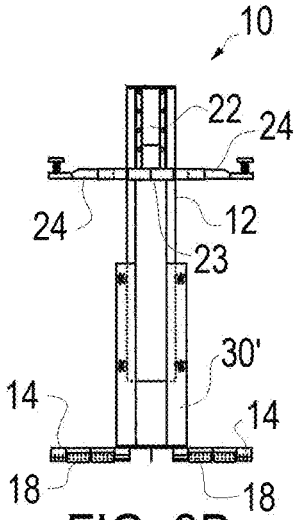
FIG. 3B is a schematic front end view a portable vehicle lift with a vertically adjustable post according to FIG. 3A.
Figure 3C:
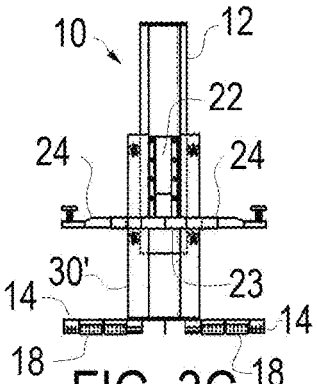
FIG. 3C is a schematic front end view a portable vehicle lift with a vertically adjustable post according to FIG. 3A with the post shown in a shortened position.
Figure 4:
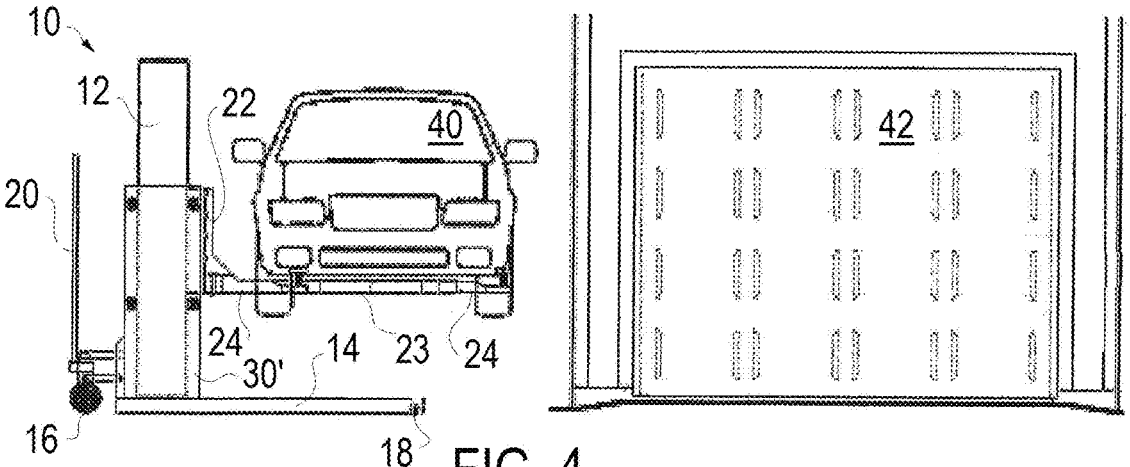
FIG. 4 is a schematic side view of a portable vehicle lift with a vertically adjustable post according to the present invention with the post shown in a shortened position and shown relative to a conventional residential garage door.

FIGS. 2A-C schematically illustrates a portable vehicle lift 10 with a vertically adjustable post 12 according to another embodiment of the present invention. This embodiment is substantially identical to the embodiment of FIGS. 1A-C except the post extension member 30 includes a hinge or pivot 32 to move the member 30 from an engaged to a disengaged position as shown in the figures. The hinged coupling via pivot 32 of the member 30 to the post 12 (or to the remainder of the post 12, as the member 30 is considered a part of the entire post 12 structure) assures that the member 30 is not lost when it is in the disengaged position. In a commercial garage it could be easy for a separate member 30 (such as in the embodiments of FIGS. 1A-C) to be disassociated from the lift 10 (e.g., effectively lost). Except for the hinged connection 32, the member 30 of the embodiment of FIGS. 2A-C is identical to the member 30 of the embodiment of FIGS. 1A-C, wherein in a first position the vertically adjustable portion formed by pivoted member 30 is aligned with a remainder of the vertical support post 12 to extend an effective height of the vertical post 12 and in a second position the vertically adjustable portion formed by pivoted member 30 is non-aligned with the remainder of the vertical support post 12 (but remains coupled thereto) to decrease an effective height of the vertical post 12 relative to the extended position.

One advantage of the embodiments of FIGS. 1A-C and 2A-C is that these designs may be retrofit to existing commercial lifts. Namely in an existing commercial lift a tall post can be cut to a desired reduced size with the severed portion being used to form the post extension member 30. A coupling of the two now separate pieces (cut post 12 and the extension member 30) needs to be added together with selective limit switches or the like in the hydraulic system 35 for proper operation in the reduced height mode.

FIGS. 3A-C and 4 schematically illustrates a portable vehicle lift 10 with a vertically adjustable post 12 according to another embodiment of the present invention. This embodiment is similar to the embodiments of FIGS. 1A-C and 2A-C except the post extension member 30 is replaced with a telescoping post extension member 30' at the base of the post 12. In this embodiment the post extension member 30' is coupled to the legs 14 and the post 12 rides within the extension member 30' somewhat analogous to the riding of the carriage 22 within the post 12. The post 12, which in this embodiment could be referenced as an inner post, begins on the ground and the car 40 is placed on the arms 24 in a standard fashion. The lift 10 actuates the cylinder and then the carriage 22 begins to raise as the carriage rides along the post 12 until it comes in contact with upper end of the post 12, then the post 12 is telescoped up, by the contact of the carriage 22, to a desired height (e.g., limited by the roof of the room). It is possible to use a second post extension member 30' nested within the first post extension member 30' to yield a two stage telescoping portable post lift 10, however a single member 30' is likely to yield the desired range of motion and still yield a relatively compact post 12. The embodiment of FIGS. 3A-C and 4 has the advantage that there is no conversion from one operational height to another and the lift 10 is used in the conventional operational fashion. In the telescoping embodiment the hydraulic system 35 will also selectively moving the carriage 22 along a length of the vertically adjustable portion 30' as the vertical post 12 is nested therein.

FIG. 5 is a schematic front view of a portable vehicle lift 10 with a vertically adjustable post 12 according to the present invention further including LED lighting elements 34 on the side of the arms 24 thereof. This figure shows the embodiment of FIGS. 2A-C using the pivoted member 30, but this addition of LED lights 34 is equally applicable for all embodiments of the present invention. The LED lighting elements 34 is to give the ability to light selective areas of the underside of the vehicle 40 on the lift 10. Preferably each LED lighting element 34 is selectively controlled to be turned off and can have some directional control (i.e. pivoting the lighting element to change the direction of the emitted light). Placing the LED lighting elements 34 on the side of each arm 24 minimizes the likelihood of damage to the elements 34 when the car 40 is moved on and off of the lift 10. Independently operated, rotationally directed LED lighting elements 34 on the side of the arms 24 provides a simple system for providing workspace light to the operators.

FIG. 6 is a schematic front view of a portable vehicle lift 10 with a vertically adjustable post 12 according to the present invention further including a power take off 36 (Auxiliary Power Outlet) on the side of post 12 thereof. This figure shows the embodiment of FIGS. 1A-C using the removable member 30, but this addition of a power take off 36 is equally applicable for all embodiments of the present invention. The power take off 36 will receive power from the same source as the controls for hydraulic lift 10, which may be battery or may have a separate power cord, or typically both. The Power take off 36 is helpful because the portable lift 10 is expected to be used in numerous locations, often outside, and such location may not be in easy access to power supply. The power take off 36 prevents the need to run multiple cords to the distant worksite and improves the versatility of the lift 10.

The portable auto lift according to another aspect of the invention, wherein only one vertical post 12 is provided, may further including a slight rearward angle relative to vertical to the vertical post 12. The slight rearward angle relative to vertical for the vertical post 12 will improve stability of the single post lift 10 as the center of gravity of the lift 10 and the vehicle 40 will travel slightly rearward as the carriage 22 is raised, reducing the forward torque. A "Slight" angle in this context is less than 8 degrees, preferably less than 5 degrees and typically 2-4 degrees.

The above description is representative of the present invention and not restrictive thereof. It will be evident that various modifications to the present invention are possible without departing from the spirit and scope thereof. The scope of the present invention is defined by the appended claims and equivalents thereto.

What is claimed is:

1. A portable auto lift comprising:

a plurality of vehicle engaging arms configured to selectively engage and support a vehicle;

a frame coupled to and supporting the plurality of vehicle engaging arms a moveable carriage coupled to and supporting the frame and the plurality of vehicle engaging arms;

a vertical support post configured to receive the movable carriage that supports frame and the vehicle engaging arms, the vertical support post further including a vertically adjustable portion for selectively vertically adjusting the height of the vertical support post;

a hydraulic system for selectively moving the moveable carriage along a length of the vertical post, including selectively moving the carriage along a length of the vertically adjustable portion; and further including an array of LED lights on at least one vehicle engaging arm.

2. The portable auto lift according to claim 1 wherein the vertically adjustable portion is one of pivoted, removable, or telescoping.

3. The portable auto lift according to claim 1 wherein the lights include adjustability and the ability to turn off individual LED lights as desired.

4. The portable auto lift according to claim 1 further including a power take off outlet on the vertical support post.

5. The portable auto lift according to claim 1 further including cantilevered legs extending from the vertical support post and cantilevered leg rollers configured to be selectively moved to a disengaged position when the lift is in use.

6. The portable auto lift according to claim 1 wherein the vertical post is provided at a slight angle relative to vertical to the vertical post.

7. A portable auto lift comprising:

a vehicle engaging assembly configured to selectively engage and support a vehicle;

a moveable carriage coupled to and supporting the vehicle engaging assembly;

a vertical support post configured to receive the movable carriage that supports frame and the vehicle engaging arms, the vertical support post further including a vertically adjustable portion for selectively vertically adjusting the height of the vertical support post, wherein in a first position the vertically adjustable portion is aligned with a remainder of the vertical support post to extend an effective height of the vertical post and in a second position the vertically adjustable portion is non-aligned with the remainder of the vertical support post to decrease an effective height of the vertical post relative to the extended position;

a hydraulic system for selectively moving the moveable carriage along a length of the vertical post, including selectively moving the carriage along a length of the vertically adjustable portion.

8. The portable auto lift according to claim 7 wherein the vertically adjustable portion is pivoted between the first position and the second position.

9. The portable auto lift according to claim 8 further including an array of LED lights on the vehicle engaging assembly.

10. The portable auto lift according to claim 9 wherein the lights include adjustability and the ability to turn off individual LED lights as desired.

11. The portable auto lift according to claim 9 further including a power take off outlet on the vertical support post.

12. The portable auto lift according to claim 9 further including cantilevered legs extending from the vertical support post and cantilevered leg rollers configured to be selectively moved to a disengaged position when the lift is in use.

13. The portable auto lift according to claim 9 wherein the vertical post is provided at a slight angle relative to vertical to the vertical post.

14. A portable auto lift comprising:

a vehicle engaging assembly configured to selectively engage and support a vehicle;

a moveable carriage coupled to and supporting the vehicle engaging assembly;

a vertical support post configured to receive the movable carriage that supports frame and the vehicle engaging arms, the vertical support post further including a vertically adjustable portion pivoted to the vertical support post for selectively vertically adjusting the height of the vertical support post, wherein in a first position the vertically adjustable portion is aligned with a remainder of the vertical support post to extend an effective height of the vertical post and when pivoted to a second position the vertically adjustable portion is non-aligned with the remainder of the vertical support post to decrease an effective height of the vertical post relative to the extended position, and wherein the moveable carriage is moveable along a length of the vertical post, including selectively moving the carriage along a length of the vertically adjustable portion.

15. The portable auto lift according to claim 14 further including an array of LED lights on the vehicle engaging assembly.

16. The portable auto lift according to claim 15 wherein the lights include adjustability and the ability to turn off individual LED lights as desired.

17. The portable auto lift according to claim 14 further including a power take off outlet on the vertical support post.

18. The portable auto lift according to claim 14 further including cantilevered legs extending from the vertical support post and cantilevered leg rollers configured to be selectively moved to a disengaged position when the lift is in use.

19. The portable auto lift according to claim 14 wherein the vertical post is provided at a slight angle relative to vertical to the vertical post.

* * * * *